US005284208A

United States Patent [19]

Clemens et al.

[11] Patent Number: 5,284,208

[45] Date of Patent: Feb. 8, 1994

[54] PRODUCTION LOGGING SYSTEM USING THROUGH FLOW LINE TOOLS

[75] Inventors: Jack G. Clemens, Plano; John H. Yonker, Carrollton, both of Tex.; Asmundur Jonsson, Stabanger, Norway

[73] Assignee: Halliburton Company, Duncan, Okla.

[21] Appl. No.: 782,421

[22] Filed: Oct. 25, 1991

[51] Int. Cl.[5] ..... E21B 23/08

[52] U.S. Cl. ..... 166/383; 166/153; 166/156

[58] Field of Search ..... 166/383, 313, 153, 155, 166/156

[56] References Cited

U.S. PATENT DOCUMENTS

| | | | |
|---|---|---|---|
| 3,302,721 | 2/1967 | Yetman | 166/313 |
| 3,543,852 | 12/1970 | Taylor | 166/155 |
| 3,606,926 | 9/1971 | Schwegman | 166/383 |
| 3,957,119 | 5/1976 | Yonker | 166/315 |
| 4,844,160 | 7/1989 | Gazda | 166/217 |
| 4,860,825 | 8/1989 | Corteville et al. | 166/153 X |
| 4,896,721 | 1/1990 | Welch | 166/214 |
| 4,940,094 | 7/1990 | Lessi et al. | 166/373 |
| 5,042,297 | 8/1991 | Lessi | 73/155 |
| 5,111,880 | 5/1992 | Wittrisch et al. | 166/250 |
| 5,163,515 | 11/1992 | Tailby et al. | 166/383 |

OTHER PUBLICATIONS

The Society of Petroleum Engineers Publication SPE 22823, "A New Technique for Servicing Horizontal Wells".

"New Life From Old Oil Wells", Mechanical Engineering, Feb. 1991, pp. 37–41.

"Planning, Implementation, and Analysis of the First Troll Horizontal Well Test", Society of Petroleum Engineers, Paper No. 20963, by S. Hovland, C. Jones and T. Whittle, presented Oct. 22–24, 1990.

*Primary Examiner*—Hoang C. Dang

*Attorney, Agent, or Firm*—Tracy W. Druce; Monty L. Ross

[57] ABSTRACT

A system is provided for deploying, operating and recovering well tools through flow lines. A system is also provided for deploying, operating and recovering a through flow line production logging system, the preferred system being characterized by the use of a time delay assembly in combination with a locking locator assembly and cooperating reach members with connecting collars disposed between a pump down transport assembly and the production logging tool.

12 Claims, 3 Drawing Sheets

PRODUCTION LOGGING SYSTEM USING THROUGH FLOW LINE TOOLS

BACKGROUND OF THE INVENTION

1. Field of the Invention

This invention relates to apparatus and methods for deploying, utilizing and recovering well tools, particularly downhole production logging equipment, through a flow line in a well. As used herein, the term "TFL tools" refers to well tools that are pumped down into wells through conduits such as flow lines without being suspended or supported from the surface.

2. Description of Related Art

In the past, production logging equipment has typically been deployed in wells by the use of wireline, coiled tubing or production tubing. Such conventional well logging systems and methods of deployment cannot be used satisfactorily in all situations. One such example is in offshore production where wells are drilled in a template on the ocean floor that is located several miles away from the production platform. Another example is in horizontal wells, especially tight-radius wells or those having long lateral extensions. A system is therefore needed that will enable TFL tools such as production logging equipment to be pumped down into a well through a flow line, utilized and recovered without being suspended from the surface.

Devices and methods useful for pumping well tools downhole through well conduits have previously been disclosed, for example, in U.S. Pat. No. 3,957,119. That patent discloses the use of TFL transport or locomotive pistons joined by a stem comprising a series of interconnecting reach rods to a well tool suspended from the pistons below a circulating nipple in the well bore. In the preferred embodiment, a lock mandrel and standing valve suspended from a running tool are lowered into a no-go landing nipple. The apparatus disclosed therein does not, however, provide means adapted to releasably lock a TFL tool string into a preselected profile in a well bore while simultaneously permitting relative axial movement between the stem and locking means during operation of the well tool. When doing production logging with TFL tools, such axial movement would permit data to be logged at several different points in a well bore without repositioning the locking means.

While axial movement of a logging tool within a well bore is often desirable in order to ascertain well conditions at spaced intervals, means are also needed for limiting the rate of travel at each such interval in order to record meaningful data at a given point.

SUMMARY OF THE INVENTION

A novel system is disclosed herein for deploying, operating and recovering tools through a flow line in a well bore without suspending the tools by wireline, or from reeled or coil tubing, or from production tubing. The system of the invention preferably comprises a pump down transport assembly, a releasable locking locator assembly, a well tool disposed below the locking locator assembly, fluid recirculation means disposed between the locking locator assembly and the well tool, and means adapted to pass axially through the locking locator assembly that interconnects the pump down transport assembly to the well tool. According to one preferred embodiment of the invention, a time delay assembly is also provided between the transport assembly and the well tool for use in controlling the axial rate of travel of the interconnecting means through the locking locator assembly for limited periods at predetermined intervals.

According to another embodiment of the invention, a production logging system is disclosed herein that is adapted to be deployed, utilized and recovered through a flow line in a well bore. According to one preferred embodiment, the TFL production logging system of the invention comprises a pump down piston assembly, a time delay assembly, a locking locator assembly, production logging equipment, and means interconnecting the piston assembly and production logging equipment through the time delay assembly and locking locator assembly. A Y-block or similarly effective circulating nipple is preferably provided between the locking locator assembly and the production logging equipment for use in reversing the direction of fluid circulation through the well bore to force the piston assembly back up through the flow line toward the surface when desired. The interconnecting means preferably further comprises a plurality of reach members, most preferably fiberglass sucker rods, joined at desired intervals by collar members adapted to cooperate with the time delay assembly when passing therethrough to control the axial rate of travel of the production logging tool for limited periods. A releasing collar having a diameter greater than that of the other collar members of the interconnecting means is preferably provided above the production logging tool. The releasing tool is preferably adapted to engage the locking locator assembly in such manner that the locking locator assembly is released from a profile in the flow line when desired to permit the TFL production logging string to be pumped out of the well.

According to another embodiment of the invention, a well tool locking locator assembly is provided that comprises a generally cylindrical body having upper and lower ends and an axial bore; an upwardly extending sleeve having a downwardly extending portion slidably engaging the upper end of the body within the axial bore; an upwardly extending female socket connector attached to the upwardly extending sleeve; a first shearable means limiting sliding movement between the upwardly extending sleeve and the body, and means for locking the upwardly extending sleeve in fixed relation to the body after shearing of the first shearable means; an inner mandrel slidably engaging the lower end of the body within the axial bore; second shearable means providing limited sliding engagement between the upwardly extending sleeve and the inner mandrel; a plurality of radially expandable locator keys disposed in a recess between the body and the inner mandrel; means for biasing the locator keys radially outward through circumferentially spaced, longitudinally extending slots in the body; means on the outside surface of the inner mandrel for propping the locator keys in their radially expanded position following shearing of the first shearable means and engagement of the means for locking the upwardly extending sleeve in fixed relation to the body after shearing of the first shearable means; a downwardly facing annular shoulder inside the inner mandrel adapted to engage an upset on a stem member passing upwardly through the inner mandrel; an upwardly facing shoulder on the outside of the inner mandrel adapted to shear the second shearable means upon application of sufficient upwardly directed force to the annular shoulder inside the inner mandrel; and an annular recess in the inside wall of the downwardly extending portion of the upwardly extending sleeve adapted to receive the upwardly extending portion of the inner mandrel after shearing of the second shearable means, thereby permitting the propping means on the outside surface of the inner mandrel to move upward relative to the locator keys, unpropping them and permitting them to be cammed back into the slots in the body upon a continued application of upwardly directed force to the annular shoulder inside the inner mandrel.

According to another embodiment of the invention, a time delay assembly is provided that comprises an outer housing having an axial bore, upper and lower connecting means, a cylindrical inner mandrel slidably disposed between defined limits within the axial bore, radially expandable dogs extending through circumferentially spaced arcuate slots in the inner mandrel, the unexpanded dogs defining a circle having a diameter less than the inside diameter of the inner mandrel and the expanded dogs defining a circle having a diameter greater than the inside diameter of the inner mandrel, and means for dampening the movement of the inner mandrel in either axial direction within the axial bore whenever the unexpanded dogs engage an upset on interconnected stem members passing axially through the inner mandrel.

According to another embodiment of the invention, a method is provided for deploying, operating and recovering a tool string through a conduit disposed in a well bore without supporting the tool string from the surface, the method comprising the steps of providing a conduit and a second, substantially parallel, fluid flow path extending between the surface and a predetermined depth downhole; providing a selected internal profile in the conduit just above the predetermined depth downhole; providing means for establishing fluid communication between the conduit and the second fluid flow path at the predetermined depth downhole; providing means at the surface for selectively controlling the pressure and direction of flow through the conduit and the second fluid flow path; pumping a tool string comprising a transport assembly, locking locator assembly, well tool and means interconnecting the transport assembly and well tool downward through the conduit until the locking locator assembly engages the internal profile, the interconnecting means being adapted to pass through the locking locator assembly and being sufficiently long that the means for establishing fluid communication between the conduit and the second fluid flow path is disposed between the transport assembly and the well tool; operating the well tool; reversing the direction of fluid circulation; disengaging the locking locator assembly from the profile; and thereafter forcing the tool string back up through the conduit to the surface.

According to another embodiment of the invention, a method is provided for deploying, operating and recovering a production logging tool string through a conduit disposed in a well bore without supporting the tool string from the surface, the method comprising the steps of providing a conduit and a second, substantially parallel, fluid flow path extending between the surface and a predetermined depth downhole; providing a selected internal profile in the conduit just above the predetermined depth downhole; providing means for establishing fluid communication between the conduit and the second fluid flow path at the predetermined depth downhole; providing means at the surface for selectively controlling the pressure and direction of flow through the conduit and the second fluid flow path; pumping a tool string comprising a pump down piston assembly, a time delay assembly, a locking locator assembly, a production logging tool and means for interconnecting the piston assembly and logging tool downward through the conduit until the locking locator assembly engages the internal profile, the interconnecting means being adapted to pass through the time delay assembly and locking locator assembly and being sufficiently long that the means for establishing fluid communication between the conduit and the second fluid flow path is disposed between the piston assembly and the logging tool; reversing the direction of fluid circulation to the piston assembly to move the piston assembly, interconnecting means and logging tool upward relative to the time delay assembly and locking locator assembly; operating the logging tool to record production data at spaced intervals below the locking locator assembly; disengaging the locking locator assembly from the profile; and thereafter pumping the production logging tool string back up through the conduit to the surface.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
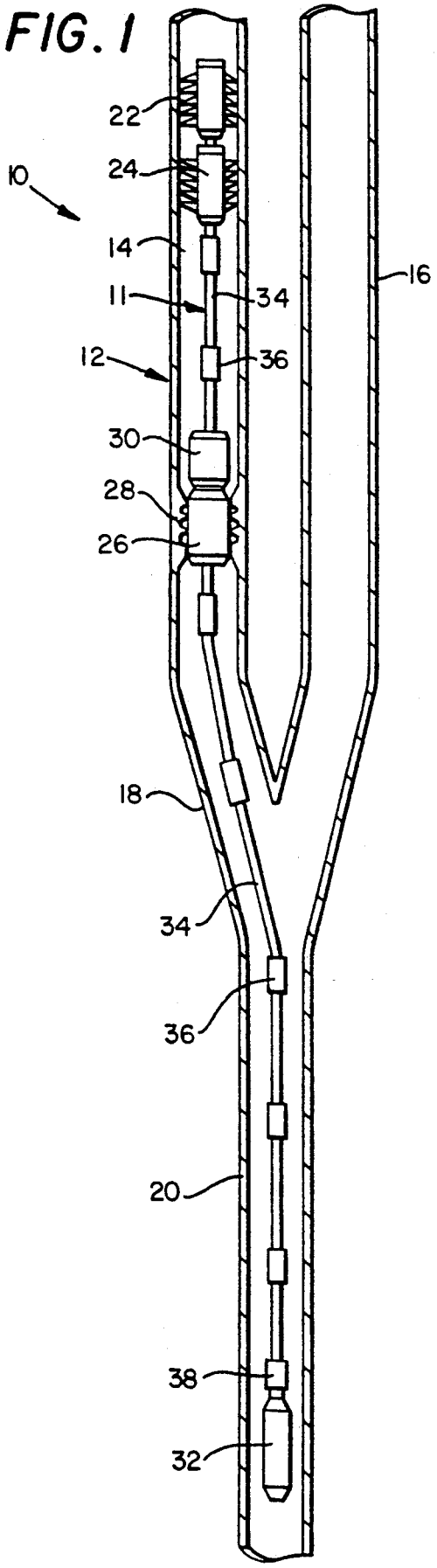
FIG. 1 is a schematic view showing the production logging system of the invention disposed inside a conduit in a downhole section of a well bore.

Although the apparatus and methods disclosed herein are specifically described in relation to the preferred embodiment of a TFL production logging system, it will be appreciated that the invention can also be used to deploy and recover TFL tools other than production logging tools. Referring to FIG. 1, production logging system 10 comprises TFL tool string 11 deployed inside a downhole section of well flow conduits 12 disposed in a well bore (not shown). Well flow conduits 12 further comprise upwardly extending flow lines 14, 16 connected by Y-block 18 to downwardly extending flow line 20. Although the use of Y-block 18 is preferred, other similarly effective means for establishing a second fluid flow path to the surface and for providing fluid communication between the two fluid flow paths can also be used within the scope of the invention. Both of flow lines 14, 16 are preferably sized to accommodate the flow of fluids from the production zone of the well bore to the surface.

TFL tool string 11 preferably comprises TFL transport means such as piston assemblies 22, 24, locking locator assembly 26 engaged in profile 28 of flow line 14, time delay assembly 30, production logging tool 32, and interconnecting means 17 preferably comprising reach members 34, connecting collars 36 and release collar 38.

The structure and operation of pump down piston assemblies of this type are well known, having previously been disclosed, for example, in U.S. Pat. No. 3,957,119. Piston cups attached to piston assembly 22 are adapted to seal against the inside surface of flow line 14 whenever fluid is forced upwardly past the piston cups of piston assembly 24. Likewise, piston cups attached to piston assembly 24 are adapted to seal against the inside surface of flow line 14 whenever fluid is forced downwardly past the piston cups of piston assembly 22.

Production logging tool 32 is suspended beneath piston assemblies 22, 24 and connected thereto by interconnecting means 17 preferably comprising a plurality of reach members 34 joined by collars 36. Reach members 34 and collars 36 are adapted to pass through axial bores in time delay assembly 30 and locking locator assembly 26. As used herein, production logging tool 32 refers to production logging equipment that can comprise a plurality of devices used to gather and record data inside flow lines 14, 20. Release collar 38 is preferably disposed above production logging tool 32, and has an outside diameter sized to engage a shoulder within locking locator assembly 26 to release locking locator assembly 26 from profile 28 in flow line 14 during removal of TFL tool string 11 from the well.

During deployment of TFL tool string 11 inside well flow conduits 12, a pump and valves (not shown) located at the surface are used to control the fluid flow through flow lines 14, 16, 20 in such manner that a pressure differential is established across piston assembly 24 that causes TFL tool string 11 to move downwardly from the surface through flow line 14 to the point where locking locator assembly 26 reaches profile 28. Once locking locator assembly 26 contacts profile 28, reach members 34 and connecting collars 36 continue to pass downward through time delay assembly 30 and locking locator assembly 26 until the downward force exerted by piston assembly 24 causes locator keys 90 (shown and described below in relation to FIGS. 3-5) in locking locator assembly 26 to engage and lock into profile 28. The distance that production logging tool 32 is suspended below piston assemblies 22, 24 is determined by the overall length of the interconnecting means 17, and corresponds approximately to the total axial distance within flow line 20 over which production logging data is desired. When TFL tool string 11 is deployed inside the well bore, Y-block 18 or another similarly effective means providing fluid communication with an alternate fluid flow path communicates with the flow line in which the TFL tool string is disposed at a point below the lowermost range of travel of piston assembly 24, and most preferably, below profile 28 and above production logging tool 32.

Once TFL tool string 11 is deployed inside the well, the pressure differential across piston assemblies 22, 24 is adjusted, preferably by operating flow valves located at the surface, so that the piston cups on piston assembly 22 will seal against the inside walls of flow line 14. This will in turn cause piston assemblies 22, 24 to move slowly upward through flow line 14, pulling reach members 34 and connecting collars 36 upwardly through the axial bores of locking locator assembly 26 and time delay assembly 30. As will be described in greater detail below in relation to FIG. 2, the rate of upward movement of production logging tool 32 is slowed each time a connecting collar 36 passes through time delay assembly 30. Periodically slowing the upward rate of travel of production logging tool 32 through flow line 20 in this manner significantly enhances the capability of production logging tool 32 for measuring and recording meaningful production data. The intervals at which the rate of travel of production logging tool 32 is thus controlled is determined by the overall length of the interconnecting means 17 and the axial spacing of connecting collars 36 adapted to engage time delay assembly 30.

When logging has been completed at each of the predetermined zones within flow line 20, piston assembly 22 is pressured upward until release collar 38 engages locking locator assembly 26. Upon application of upwardly directed pressure sufficient to disengage locking locator assembly 26 from profile 28, TFL tool string 11 is pumped back to the surface through flow line 14.

Figure 2:
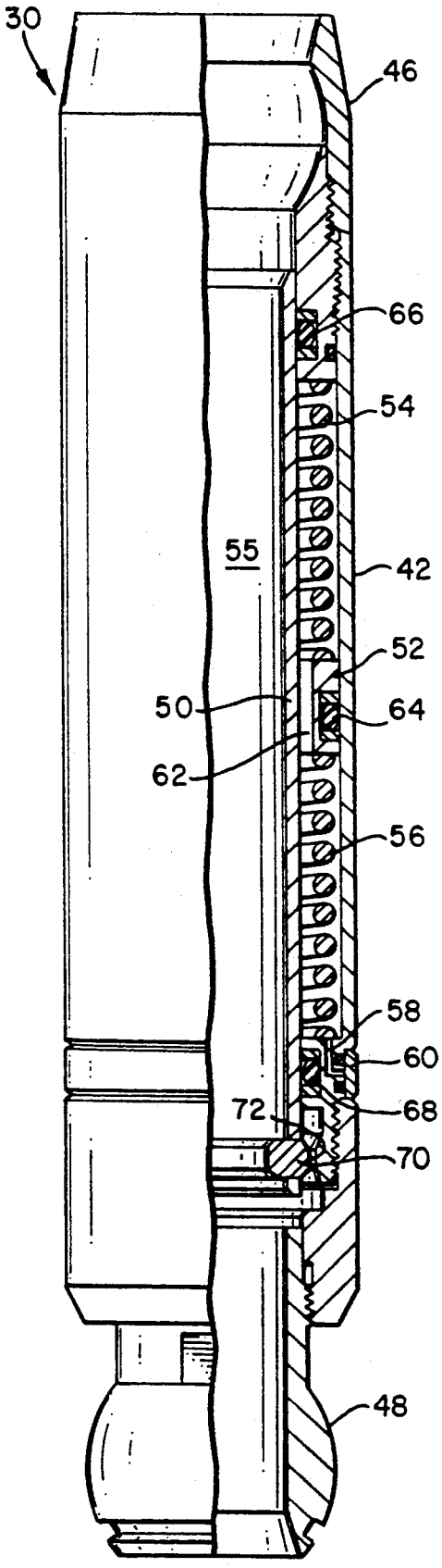
FIG. 2 is an elevation view, partially broken away and partially in section, of a preferred time delay assembly for use in the production logging system of the invention.

The structure and operation of time delay assembly 30 is further described and explained with reference to FIG. 2. Time delay assembly 30 preferably comprises substantially cylindrical outer housing 42 having female socket connecting means 46 and male ball connecting means 48 threadedly engaged therewith at its upper and lower ends, respectively. Substantially cylindrical inner mandrel 50 is slidably disposed inside outer housing 42, and cooperates with outer housing 42 and connecting means 46, 48 to define axial bore 55. Inner mandrel 50 further comprises an annular boss 52 having at least one dampening fluid flow channel 62 extending axially therethrough. Biasing means such as coil springs 54, 56 are preferably disposed above and below boss 52, respectively, in the annular space between outer housing 42 and inner mandrel 50. Sealing means 64 are provided between the radially extending edge of boss 52 and the inside surface of outer housing 42. Sealing means 66, 68 are likewise provided between outer housing 42 and inner mandrel 50. A viscous dampening fluid is preferably injected into the void space around coil springs 54, 56 between outer housing 42 and inner mandrel 50 through dampening fluid fill port 58, which is then sealed by cover ring 60 prior to use in the field.

A plurality of radially expandable dogs 70 preferably extend through circumferentially spaced arcuate slots in inner mandrel 50. When unexpanded, dogs 70 partially occlude axial bore 55. When a connecting collar 36 as previously described in relation to FIG. 1 passes through axial bore 55, it engages dogs 70. Because the force required to expand dogs 70 is slightly greater than the force initially required to slide inner mandrel 50 along the inside of outer housing 42 against the combined biasing force exerted by coil springs 54, 56 and the force exerted by the dampening fluid flowing through flow channel 62, connecting collar 36 initially remains in contact with dogs 70, but the rate of travel of the collar through time delay assembly 30 is slowed. When the biasing pressure exerted against boss 52 becomes great enough to overpressure dogs 70, they are cammed into annular recesses 72 in outer housing 42 by connecting collar 36, permitting connecting collar 36 to resume its rate of travel prior to contacting dogs 70.

It will therefore be appreciated that whenever a connecting collar 36 enters time delay assembly 30 and engages expandable dogs 70, the rate at which production logging tool 32 is moving upwardly through flow line 20 is slowed until such time as dogs 70 expand, permitting collar 36 to pass. Production logging tool 32, which operates continuously, is therefore able to collect and record meaningful production data whenever each successive connecting collar 36 reaches and engages time delay assembly 30. By controlling the axial spacing between connecting collars 36 in conjunction with the overall length of TFL tool string 11, one can preselect the number and spacing of zones in which production logging tool 32 will be able to record meaningful data. Similarly, by controlling pressure differential across piston assemblies 22, 24, the length of time delay assembly 30, the strength of coil springs 54, 56, the viscosity of the dampening fluid, the number and diameter of the dampening fluid flow channels 62, and the force required to expand dogs 70, one can adjust the amount of time that the axial movement of production logging tool 32 will be slowed within flow line 20.

Although the use of time delay assembly 30 in cooperation with connecting collars 36 is a preferred method for intermittently controlling the axial rate of travel of production logging tool 32 within a flow line in accordance with the system of the invention, it will be understood and appreciated upon reading this disclosure that similar results can be achieved by providing a plurality of time delay devices axially spaced along the interconnecting means. Such devices could be adapted to cooperate with the locking locator assembly or other apparatus to produce the desired function.

Figure 3:
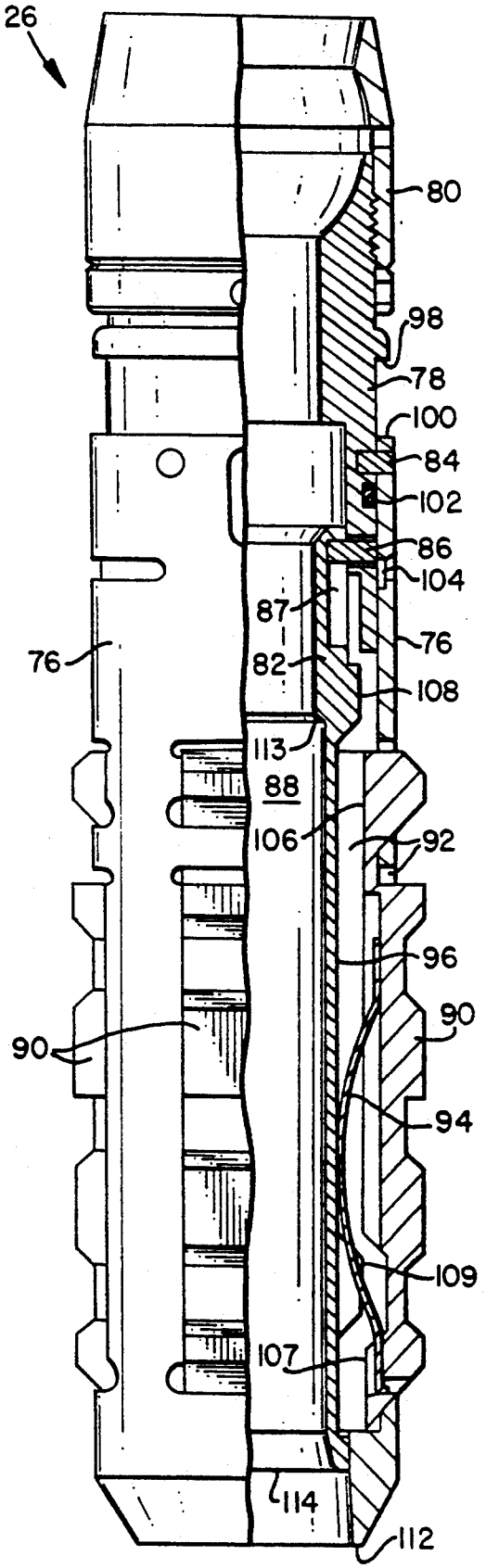
FIG. 3 is an elevation view, partially broken away and partially in section, of a preferred locking locator assembly for use in the production logging system of the invention in the configuration in which it is pumped down through a conduit into a well bore.
Figure 4:
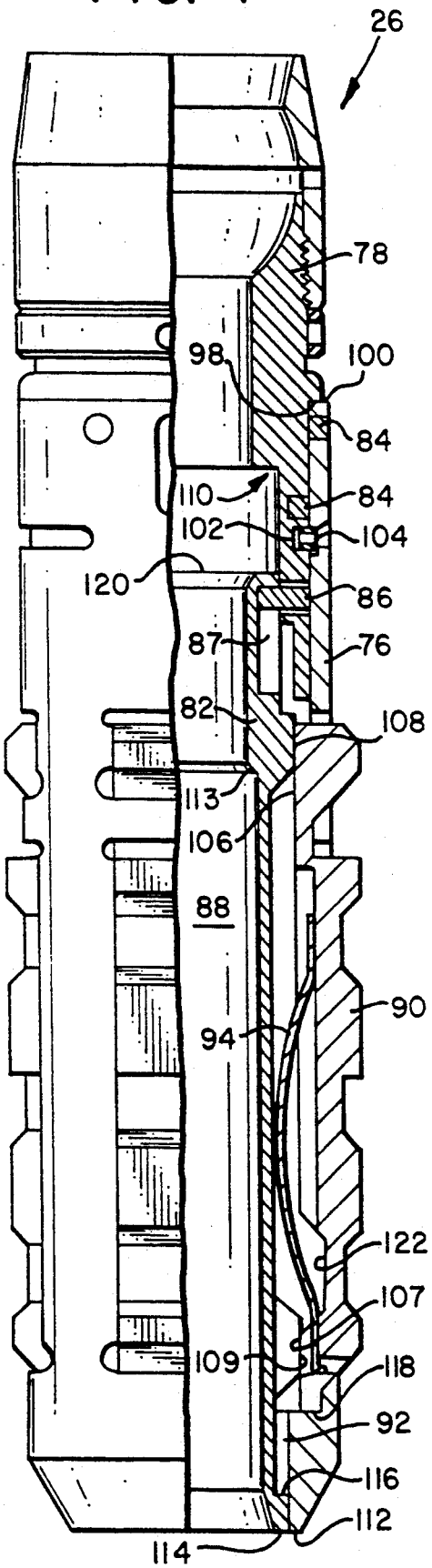
FIG. 4 is an elevation view, partially broken away and partially in section, of the preferred locking locator assembly of FIG. 3 in the configuration in which it is locked into a compatible internal profile inside a conduit in a well bore.
Figure 5:
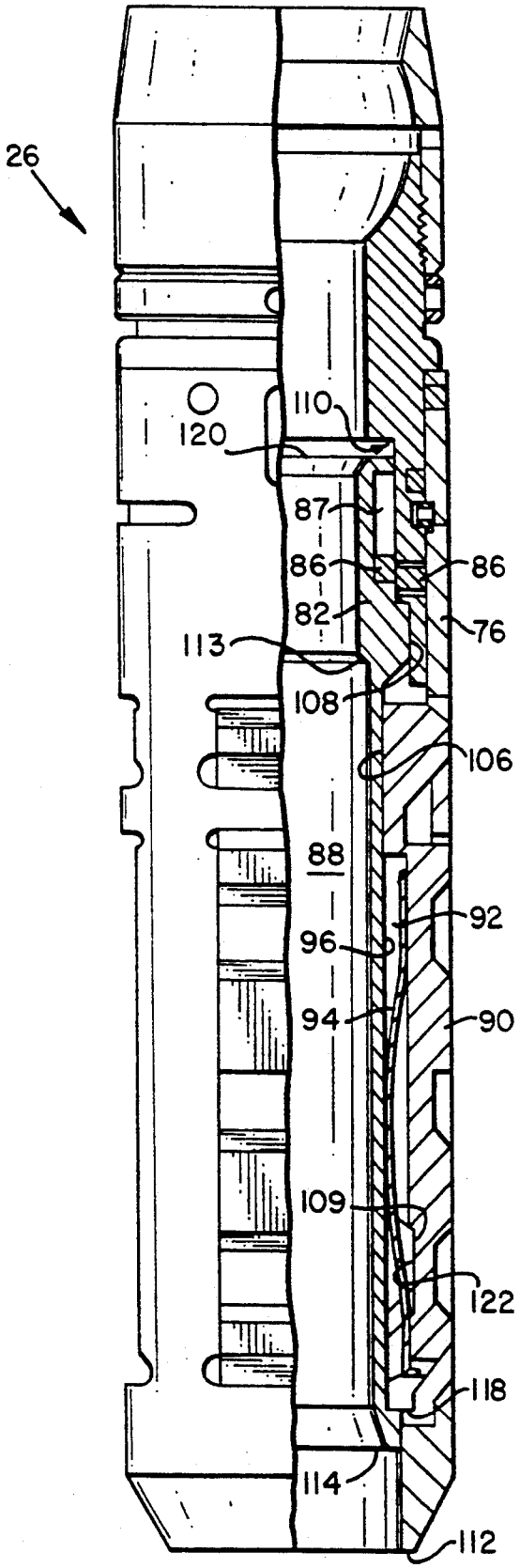
FIG. 5 is an elevation view, partially broken away and partially in section, of the preferred locking locator assembly of FIG. 3 in the configuration in which it is released from the internal profile for removal from the well bore.

Locking locator assembly 26 of the invention is further described and explained in relation to FIGS. 3 through 5 of the drawings. Referring to FIG. 3, locking locator assembly 26 preferably comprises body 76; upwardly extending sleeve 78 slidably engaging the upper end of body 76 and pinned thereto by shear pin 84; a plurality of circumferentially spaced locator keys 90 biased radially outward through slots 92 in body 76 by leaf springs 94; an inner mandrel 82 slidably disposed inside body 76 and slidably interconnected with upwardly extending sleeve 78 by shear pin 86 in slot 87; body 76, upwardly extending sleeve 78 and inner mandrel 82 cooperating to define substantially cylindrical axial bore 88; and radially extending surfaces 108, 109 disposed on outside surface 96 of inner mandrel 82 which are adapted to engage and prop inside surfaces 106, 107 of locator keys 90 outwardly into engagement with profile 28 of flow line 14 as previously shown and described in relation to FIG. 1.

As TFL tool string 11 is lowered through flow line 14, locator keys 90 are biased radially outward by leaf springs 94 or other similarly effective means until such time as they engage a receptive profile such as profile 28 depicted in simplified form in FIG. 1. Because many different profiles are commercially available, several such profiles can be provided in a single flow line for use in production logging or other operations at various depths in a well bore.

After locator keys 90 engage profile 28, sufficient downward pressure is applied against locking locator assembly 26 by piston assemblies 22, 24 that pin 84 shears, as shown in FIGS. 3 and 4, causing sleeve 78 to slide into closer engagement with body 76 and causing shoulder 98 of sleeve 78 to slide into contact with shoulder 100 of body 76. When this happens, outwardly biased C-ring 102 in sleeve 78 snaps into annular groove 104 in body 76, thereby locking body 76 to sleeve 78. Simultaneously, inwardly facing surfaces 106, 107 of locator keys 90 are propped into the expanded position as shown in FIG. 4 by surfaces 108, 109 of inner mandrel 82.

During operation of production logging tool 32 as discussed above, reach members 34 and connecting collars 36 pass upwardly through axial bore 88 of locking locator assembly 26 without affecting its configuration or performance. This is because the outside diameter of connecting collars 36 is not great enough to engage annular shoulder 113 of axial bore 88. Thus, locking locator assembly 26 remains in the configuration shown in FIG. 4 until such time as piston assemblies 22, 24 have been forced sufficiently upward in flow line 14 that release collar 38 engages and seats against annular shoulder 113 in axial bore 88. The outside diameter of release collar 38 is preferably such that it will enter axial bore 88, but will not proceed beyond annular shoulder 113.

When a sufficient upwardly directed pressure differential is created across piston assemblies 22, 24 that shear pin 86 is overpressured, pin 86 will shear as shown in FIG. 5, at which time bottom edge 114 of inner mandrel 82 will move upward relative to bottom edge 112 of body 76 from the position shown in FIG. 4 to the position shown in FIG. 5. When this happens, surfaces 108, 109 of inner mandrel 82 will unprop bottom surfaces 106, 107 of locator keys 90, locator keys 90 will be cammed radially inward through slots 92 in body 76, and shoulder 116 of inner mandrel 82 will move upward against bottom edge 118 of locator keys 90. In this position, surface 107 of inner mandrel 82 nests inside recess 122 on the inside surface of locator keys 90. With locator keys 90 retracted in this manner, the differential pressure applied to piston assemblies 22, 24 will cause TFL tool string 11 to flow upwardly through flow line 14 to the surface.

Figure 6:
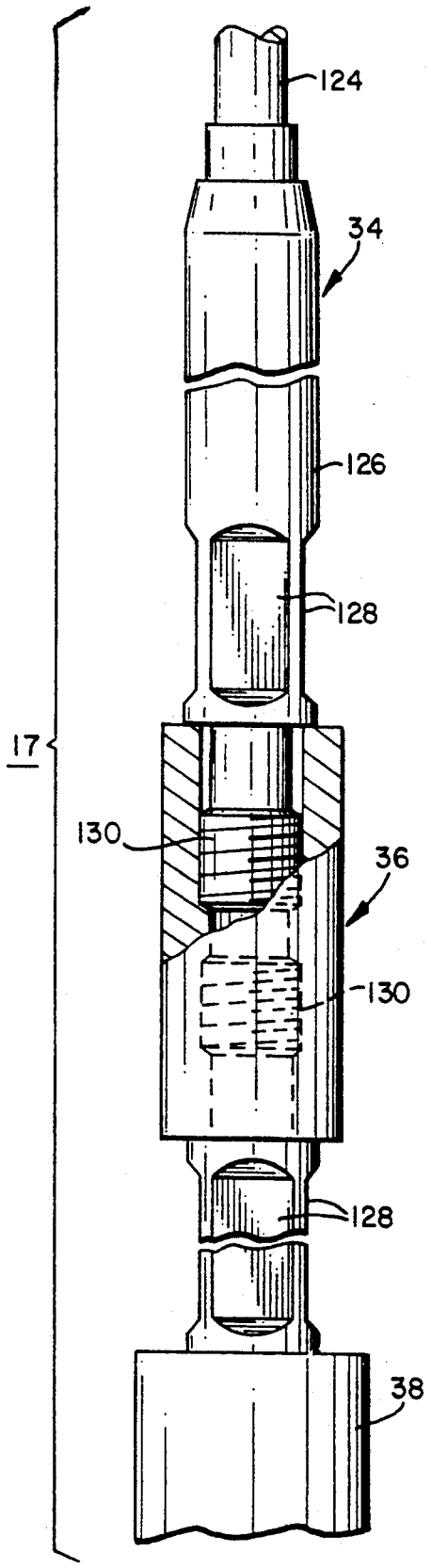
FIG. 6 is a detailed elevation view, partially broken away and partially in section, of a preferred sucker rod connector assembly adapted to cooperate with the time delay assembly and locator lock assembly in the production logging system of the invention.

The structure of interconnecting means 17 is further described and explained in relation to FIG. 6. Referring to FIG. 6, interconnecting means 17 preferably comprises a plurality of reach members 34 coupled by connecting collars 36, and having a single release collar 38 disposed at the lower end thereof. Reach members 34 preferably comprise fiberglass sucker rods 124 having a nominal diameter of $\frac{3}{4}$ inch. Sucker rods 124 are preferably provided with end pieces 126 having wrench flats 128 and threaded pin sections 130 at each end thereof. Although, as discussed below, other materials can be used as reach members 34 in place of fiberglass sucker rods 124, fiberglass sucker rods are preferred because of their resistance to taking on a permanent set when maintained in a flexed position during use. Such setting can create undesirable side loads on the locator keys of the locking locator assembly 26.

Connecting collars 36 preferably comprise metal collars having internally threaded portions adapted to receive and join two sections of sucker rod 124 in endto-end relation. According to a preferred embodiment of the invention, connecting collars 36 used to join $\frac{3}{4}$ inch fiberglass sucker rod will have an outside diameter of about $1\frac{1}{4}$ inches. By comparison, the outside diameter of release collar 38 is preferably about $1\frac{3}{8}$ inches.

The length of the individual reach members 34 joined by connecting collars 36 does not have to correspond in every instance to the axial intervals at which production logging data is desired. Where, for example, the distance between desired data logging locations is greater than the distance traversed by a single fiberglass sucker rod 124, connecting collars 36 having outside diameters less than that required to engage expandable dogs 70 of time delay assembly 30 can be employed except in those instances where such engagement is desired. In most wells, the maximum desirable length of individual reach members 34 will depend upon the radius of arcuate sections of flow line through which TFL tool string 11 must pass during deployment in the well, the flexibility of the material used as the interconnecting means, and the degree of flexure permitted by the design of the connecting devices used to join individual reach members 34.

Although reach members 34 comprising fiberglass sucker rods 124 are preferred for use in the system of the invention because of their relatively low cost, availability in various lengths and their resistance to setting, it will be understood that other similarly effective interconnecting means can also be used. Thus, for example, metal sucker rods, coiled tubing, or other non-metallic composites can be substituted for the fiberglass sucker rods. Where, for example, coiled tubing is used in place of the fiberglass sucker rods, upsets having diameters corresponding to the outside diameters of connecting collars 36 and release collar 38, respectively, can be provided to cooperate with time delay assembly 30 in controlling the rate of travel of production logging tool 32 through flow line 20.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A system for deploying, operating and recovering tools through a flow line in a well bore, the system comprising:

a fluid recirculation means for controlling the direction of fluid flow within said flow line, an interconnecting means disposed in the flow line, a pump down transport assembly connected upon the interconnecting means, a releasable locking locator assembly disposed about said interconnecting means for relative motion therewith and so that said interconnecting means is capable of axial travel within said flow line, and a well tool connected upon the interconnecting means.

2. The system of claim 1, further comprising:

a time delay assembly adjacent to said locking locator assembly and disposed about said interconnecting means for relative motion therewith; and said time delay assembly capable of intermittently controlling the axial travel of the interconnecting means at a desired rate.

3. The system of claim 1 wherein the locking locator assembly comprises a generally cylindrical body having upper and lower ends and an axial bore; an upwardly extending sleeve having a downwardly extending portion slidably engaging the upper end of the body within the axial bore; an upwardly extending female socket connector attached to the upwardly extending sleeve; a first shearable means limiting sliding movement between the upwardly extending sleeve and the body, and means for locking the upwardly extending sleeve in fixed relation to the body after shearing of the first shearable means; an inner mandrel slidably engaging the lower end of the body within the axial bore; second shearable means providing limited sliding engagement between the upwardly extending sleeve and the inner mandrel; a plurality of radially expandable locator keys disposed in a recess between the body and the inner mandrel; means for biasing the locator keys radially outward through circumferentially spaced, longitudinally extending slots in the body; means on the outside surface of the inner mandrel for propping the locator keys in their radially expanded position following shearing of the first shearable means and engagement of the means for locking the upwardly extending sleeve in fixed relation to the body after shearing of the first shearable means; a downwardly facing annular shoulder inside the inner mandrel engageable by a release collar passing upwardly into the inner mandrel; an upwardly facing shoulder on the outside of the inner mandrel adapted to shear the second shearable means upon application of sufficient upwardly directed force to the annular shoulder inside the inner mandrel; and an annular recess in the inside wall of the downwardly extending portion of the upwardly extending sleeve adapted to receive the upwardly extending portion of the inner mandrel after shearing of the second shearable means.

4. The system of claim 2 wherein the time delay assembly comprises an outer housing having an axial bore, upper and lower connecting means, a cylindrical inner mandrel slidably disposed between defined limits within the axial bore, radially expandable dogs extending through circumferentially spaced arcuate slots in the inner mandrel, the unexpanded dogs defining a circle having a diameter less than the inside diameter of the inner mandrel and the expanded dogs defining a circle having a diameter greater than the inside diameter of the inner mandrel, and means for dampening the movement of the inner mandrel in either axial direction within the axial bore.

5. A production logging system adapted to be deployed, utilized and recovered through a flow line in a well bore, the system comprising:

an interconnecting means disposed in the flow line, a pump down piston assembly connected upon said interconnecting means, a locking locator assembly disposed about said interconnecting means for relative motion therewith, a time delay assembly adjacent to said locking locator assembly and disposed about said interconnecting means for relative motion therewith, and production logging equipment connected upon the interconnecting means, and said interconnecting means interconnecting the piston assembly and production logging equipment through the time delay assembly and locking locator assembly.

6. The production logging system of claim 5 wherein the interconnecting means further comprises a plurality of reach members joined at desired intervals by collar members which cooperate with the time delay assembly upon passing therethrough to control the axial rate of travel of the collar members through the time delay assembly.

7. The production logging system of claim 6, further comprising a release collar having a diameter greater than that of the collar members of the interconnecting means.

8. The production logging system of claim 7 wherein the release collar is adapted to disengage the locking locator assembly from a profile in the flow line.

9. The production logging system of claim 5 wherein the locking locator assembly comprises a generally cylindrical body having upper and lower ends and an axial bore; an upwardly extending sleeve having a downwardly extending portion slidably engaging the upper end of the body within the axial bore; an upwardly extending female socket connector attached to the upwardly extending sleeve; a first shearable means limiting sliding movement between the upwardly extending sleeve and the body, and means for locking the upwardly extending sleeve in fixed relation to the body after shearing of the first shearable means; an inner mandrel slidably engaging the lower end of the body within the axial bore; second shearable means providing limited sliding engagement between the upwardly extending sleeve and the inner mandrel; a plurality of radially expandable locator keys disposed in a recess between the body and the inner mandrel; means for biasing the locator keys radially outward through circumferentially spaced, longitudinally extending slots in the body; means on the outside surface of the inner mandrel for propping the locator keys in their radially expanded position following shearing of the first shearable means and engagement of the means for locking the upwardly extending sleeve in fixed relation to the body after shearing of the first shearable means; a downwardly facing annular shoulder inside the inner mandrel engageable by a release collar passing upwardly into the inner mandrel; an upwardly facing shoulder on the outside of the inner mandrel adapted to shear the second shearable means upon application of sufficient upwardly directed force to the annular shoulder inside the inner mandrel; and an annular recess in the inside wall of the downwardly extending portion of the upwardly extending sleeve adapted to receive the upwardly extending portion of the inner mandrel after shearing of the second shearable means.

10. The production logging system of claim 5 wherein the time delay assembly comprises an outer housing having an axial bore, upper and lower connecting means, a cylindrical inner mandrel slidably disposed between defined limits within the axial bore, radially expandable dogs extending through circumferentially spaced arcuate slots in the inner mandrel, the unexpanded dogs defining a circle having a diameter less than the inside diameter of the inner mandrel and the expanded dogs defining a circle having a diameter greater than the inside diameter of the inner mandrel, and means for dampening the movement of the inner mandrel in either axial direction within the axial bore.

11. A method for deploying, operating and recovering a tool string through a conduit disposed in a well bore without supporting the tool string from the surface, the method comprising the steps of:

providing a conduit and a second, substantially parallel, fluid flow path extending between the surface and a predetermined depth downhole;

providing a selected internal profile in the conduit just above the predetermined depth downhole;

providing means for establishing fluid communication between the conduit and the second fluid flow path at the predetermined depth downhole;

providing means at the surface for selectively controlling the pressure and direction of flow through the conduit and the second fluid flow path;

pumping a tool string comprising a transport assembly, locking locator assembly, well tool and means interconnecting the transport assembly and well tool downward through the conduit until the locking locator assembly engages the internal profile, the interconnecting means passing through the locking locator assembly and being sufficiently long that the means for establishing fluid communication between the conduit and the second fluid flow path is disposed between the transport assembly and the well tool;

operating the well tool; reversing the direction of fluid circulation;

disengaging the locking locator assembly from the profile;

and thereafter forcing the tool string back up through the conduit to the surface.

12. A method for deploying, operating and recovering a production logging tool string through a conduit disposed in a well bore without supporting the tool string from the surface, the method comprising the steps of:

providing a conduit and a second, substantially parallel, fluid flow path extending between the surface and a predetermined depth downhole;

providing a selected internal profile in the conduit just above the predetermined depth downhole;

providing means for establishing fluid communication between the conduit and the second fluid flow path at the predetermined depth downhole;

providing means at the surface for selectively controlling the pressure and direction of flow through the conduit and the second fluid flow path; pumping a tool string comprising a pump down piston assembly, a time delay assembly, a locking locator assembly, a production logging tool and means for interconnecting the piston assembly and logging tool downward through the conduit until the locking locator assembly engages the internal profile, the interconnecting means being adapted to pass through the time delay assembly and locking locator assembly and being sufficiently long that the means for establishing fluid communication between the conduit and the second fluid flow path is disposed between the piston assembly and the logging tool;

reversing the direction of fluid circulation to the piston assembly to move the piston assembly, interconnecting means and logging tool upward relative to the time delay assembly and locking locator assembly;

operating the logging tool to record production data at spaced intervals below the locking locator assembly;

disengaging the locking locator assembly from the profile;

and thereafter pumping the production logging tool string back up through the conduit to the surface.

* * * * *